US009556696B2

(12) United States Patent
Donovan et al.

(10) Patent No.: US 9,556,696 B2
(45) Date of Patent: Jan. 31, 2017

(54) WINDOW MILLING SYSTEMS WITH EXPANDABLE BLADES FOR SECURING A WHIPSTOCK ASSEMBLY AND METHOD OF USE

(71) Applicant: HALLIBURTON ENERGY SERVICES, INC., Houston, TX (US)

(72) Inventors: Stacey B. Donovan, Fort Worth, TX (US); William W. Dancer, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 325 days.

(21) Appl. No.: 14/172,011

(22) Filed: Feb. 4, 2014

(65) Prior Publication Data

US 2014/0251615 A1 Sep. 11, 2014

(30) Foreign Application Priority Data

Mar. 5, 2013 (WO) ..... PCT/US2013/029039

(51) Int. Cl.
*E21B 29/06* (2006.01)
*E21B 7/06* (2006.01)

(52) U.S. Cl.
CPC ..... *E21B 29/06* (2013.01); *E21B 7/061* (2013.01)

(58) Field of Classification Search
CPC ..... E21B 7/061; E21B 29/06
See application file for complete search history.

(56) References Cited

U.S. PATENT DOCUMENTS 5,228,507 A 7/1993 Obrejanu et al.
5,727,629 A 3/1998 Blizzard, Jr. et al.
5,769,166 A 6/1998 Duke
(Continued)

FOREIGN PATENT DOCUMENTS

CN 1209858 3/1999
CN 101718171 6/2010
(Continued)

OTHER PUBLICATIONS

International Search Report and Written Opinion issued Nov. 19, 2013 for PCT Application No. PCT/US2013/029039, 19 pages.
(Continued)

*Primary Examiner* — Catherine Loikith
(74) *Attorney, Agent, or Firm* — Chamberlain Hrdlicka

(57) ABSTRACT

A window milling system can include a window mill having selectively retractable and extendable blades, and a whipstock assembly having a receptacle therein, the window mill being secured relative to the whipstock assembly the blades are received in the receptacle. A method of cutting a window through a wellbore lining can include cutting through the lining with a window mill, then retracting blades of the window mill, and then outwardly extending the blades in a whipstock assembly, thereby securing the whipstock assembly to the window mill. A window mill can include multiple blades adapted for cutting through a wellbore lining, the blades being outwardly extendable relative to a body of the window mill in a well. Another method of cutting a window through a wellbore lining can include a window mill drilling a wellbore outward a substantial distance from the window after the window mill cutting through the lining.

39 Claims, 6 Drawing Sheets

(56) References Cited

U.S. PATENT DOCUMENTS

| | | | | |
|---|---|---|---|---|
| 8,371,368 | B2 | 2/2013 | Steele et al. | |
| 2005/0167113 | A1 | 8/2005 | Smith et al. | |
| 2008/0017378 | A1 | 1/2008 | McGlothen et al. | |
| 2008/0093076 | A1* | 4/2008 | Patil | E21B 7/064 166/298 |
| 2009/0133877 | A1 | 5/2009 | Neff | |
| 2010/0224414 | A1 | 9/2010 | Radford et al. | |
| 2011/0220357 | A1 | 9/2011 | Segura et al. | |

FOREIGN PATENT DOCUMENTS

| | | |
|---|---|---|
| CN | 102206991 | 10/2011 |
| WO | 0058594 A1 | 10/2000 |

OTHER PUBLICATIONS

Halliburton, "Mill Assembly, Window, 10.45" OD API-NC56 W/Stress Relief Groove, 11 7/8 Flexrite Deep", dated Dec. 30, 2010, Drawing No. 12MLD1041, 1 page.

Halliburton, "Hydraulic Retrieving Tool for Use With 10 3/4 Whipstocks and 9/5/8 Longer Whipstocks", dated Jan. 18, 2009, Drawing No. 12MLR1035, 1 page.

Sperry-Sun, "ITBS Window Assembly—L80—13CR ITBS Hi-Torque", dated Nov. 29, 2004, Drawing No. D00171589, 2 pages.

* cited by examiner

WINDOW MILLING SYSTEMS WITH EXPANDABLE BLADES FOR SECURING A WHIPSTOCK ASSEMBLY AND METHOD OF USE

CROSS-REFERENCE TO RELATED APPLICATION

This application claims the benefit under 35 USC §119 of the filing date of International Application Serial No. PCT/US13/29039 filed 5 Mar. 2013. The entire disclosure of this prior application is incorporated herein by this reference.

BACKGROUND

This disclosure relates generally to equipment utilized and operations performed in conjunction with a subterranean well and, in one example described below, more particularly provides a window mill with retractable blades, and a window milling and wellbore drilling system.

Window mills (e.g., lead mills, "watermelon" or barrel mills, etc.) are used to cut windows through wellbore linings (such as casing or liner). Whipstock assemblies include deflectors which deflect window mills laterally, in order to cut the windows. It will be appreciated that improvements are continually needed in the arts of constructing and operating window mills and whipstock assemblies.

DETAILED DESCRIPTION

Figure 1:
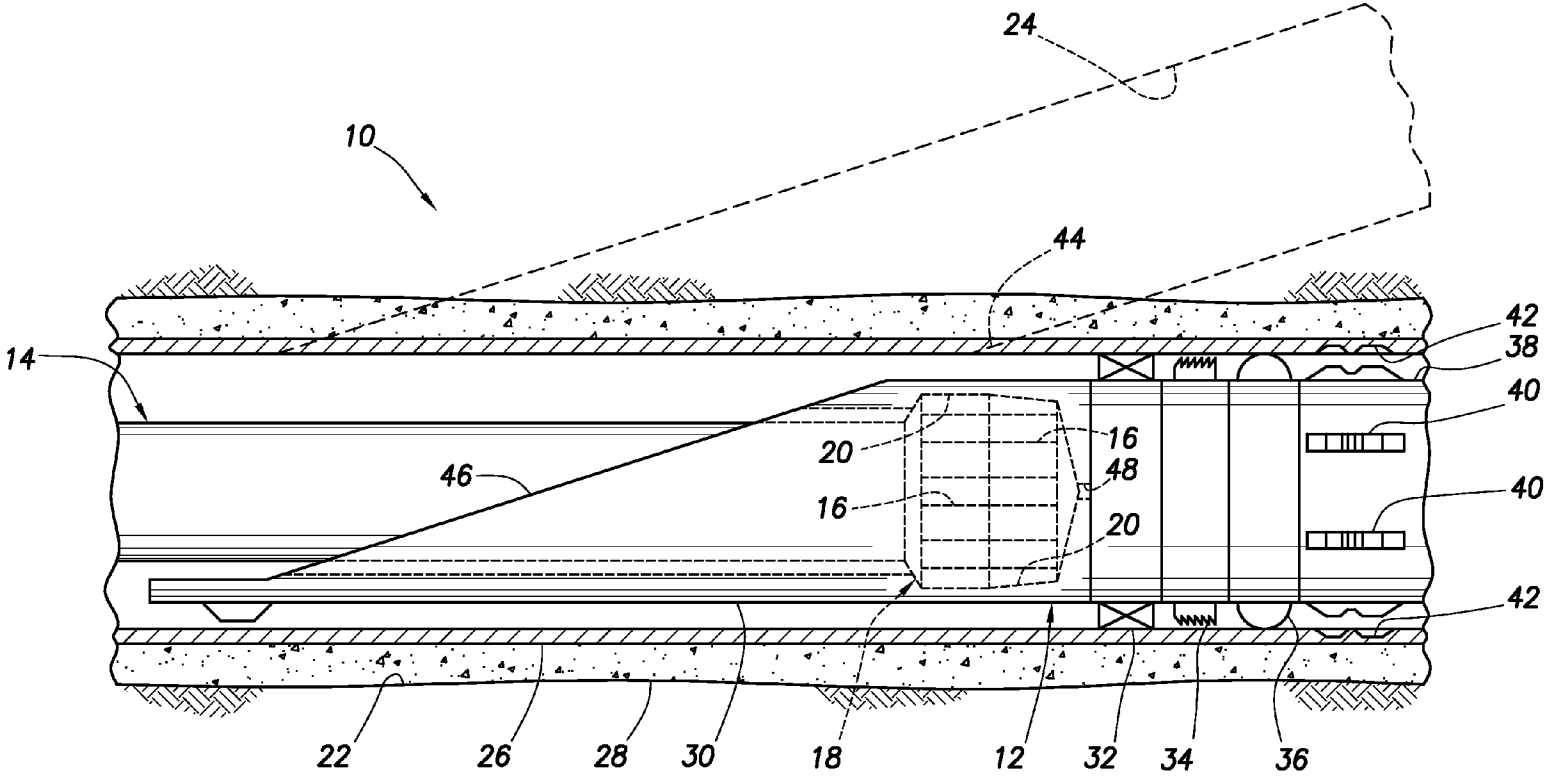
FIG. 1 is a representative partially cross-sectional view of a window milling system and associated method which can embody principles of this disclosure.

Representatively illustrated in FIG. 1 is a window milling system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a whipstock assembly 12 is secured to a tubular string 14 (such as, a drill string, a work string, etc.) using outwardly extendable blades 16 on a window mill 18. The extended blades 16 are received in one or more receptacles 20 formed in the whipstock assembly 12.

In this manner, the tubular string 14 can be used for conveying the whipstock assembly 12 into a wellbore 22 from which another wellbore 24 is to be drilled. The whipstock assembly 12 can also be retrieved from the wellbore 22 by securing the window mill 18 in the whipstock assembly (such as, by outwardly extending the blades 16 into engagement with the receptacles 20), and then lifting the whipstock assembly with the tubular string 14.

In the FIG. 1 example, the wellbore 22 is generally horizontal, and the wellbore 24 is to be drilled in an inclined upward direction from the wellbore 22. However, in other examples, the wellbore 22 could be generally vertical or inclined, the wellbore 24 could be drilled in other directions, etc. The wellbore 22 is depicted in FIG. 1 as being lined with a wellbore lining 26 (e.g., casing or liner, etc.) and cement 28, but in other examples the cement may not be used. Thus, the scope of this disclosure is not limited to any of the details of the system 10 and method as depicted in FIG. 1.

The whipstock assembly 12 includes a deflector 30, an annular seal 32, a gripping device 34, a centralizer 36 and an orienting latch 38. The latch 38 includes keys 40 which are specially configured to complementarily engage matching profiles 42 formed in the wellbore lining 26. Such engagement longitudinally and azimuthally aligns the deflector 30 with a window 44 to be formed through the wellbore lining.

When the blades 16 are retracted (e.g., after the whipstock assembly 12 has been conveyed into the wellbore 22, and the keys 40 have engaged the profiles 42), the window mill 18 is released from the receptacles 20 and can be displaced to the left (as viewed in FIG. 1) of a deflector surface 46 formed on the deflector 30. Then, the blades 16 can be extended outwardly, prior to displacing the tubular string 14 and mill 18 to the right (as viewed in FIG. 1), so that the window mill 18 can engage the deflector surface 46 and be laterally deflected to cut the window 44 through the wellbore lining 26.

As the tubular string 14 and mill are displaced to the right, the deflector surface 46 laterally deflects the window mill 18, so that the window mill cuts the window 44 through the wellbore lining 26. After the window 44 is cut, the blades 16 can again be retracted, so that the window mill 18 can again be received in the whipstock assembly 12.

The blades 16 can then be extended outwardly into engagement with the receptacles 20. With the window mill 18 thusly secured in the whipstock assembly 12, the tubular string 14 can be used to retrieve the whipstock assembly from the wellbore 22.

Note that the above operations can be completed in only a single trip of the tubular string 14 and whipstock assembly 12 into the wellbore 22. The engagement between the expandable window mill 18 and the receptacles 20 can be used both to convey the whipstock assembly 12 into the wellbore 22, and to retrieve the whipstock assembly from the wellbore after the window 44 is milled through the wellbore lining 26.

The annular seal 32 may be active or passive, that is, the seal may be actively extended outward into sealing contact with the wellbore lining 26, or the seal may continuously engage the wellbore lining. If the seal 32 is active, pressure may be supplied to actuate the seal via a passage 48 extending between the window mill 18 and the seal in the deflector 30.

The gripping device 34 may be used as an anchor to react forces applied to the whipstock assembly 12 when the window mill 18 is being used to cut through the wellbore lining 26. The gripping device 34 may be in the form of slips or other gripping members, which may be outwardly extendable from the whipstock assembly 12. Note that the gripping device 34 may not be used if the engagement between the keys 40 and profiles 42 is sufficient to react the forces produced by the milling operation.

The centralizer 36 centers the whipstock assembly 12 in the wellbore lining 26. Use of the centralizer 36 is optional, since the seal 32, gripping device 34 and/or latch 38 may adequately centralize the whipstock assembly 12 in the wellbore lining 26.

Figure 2:
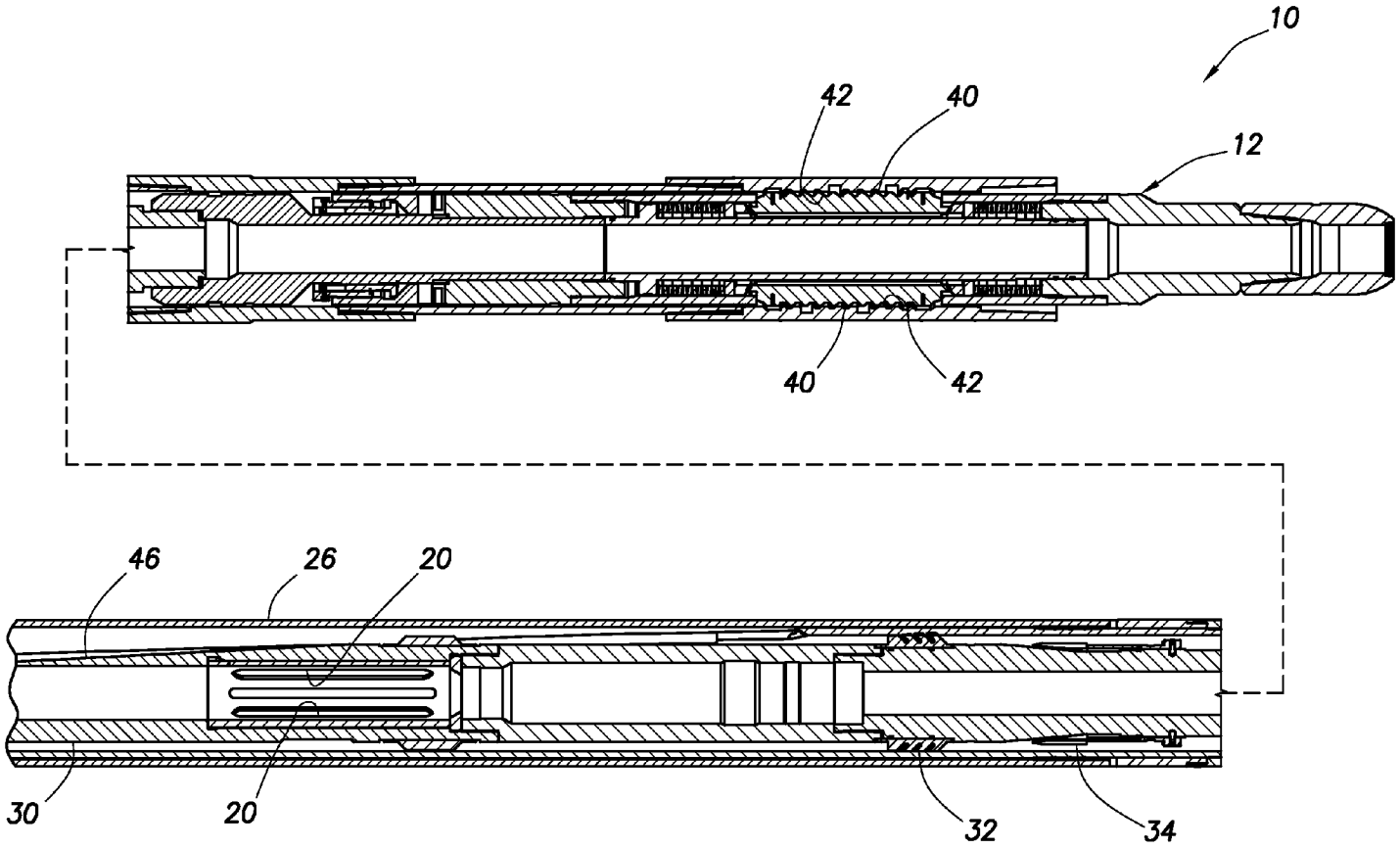
FIG. 2 is a representative cross-sectional view of a whipstock assembly which may be used in the system and method of FIG. 1.

Referring additionally now to FIG. 2, a more detailed cross-sectional view of one example of the whipstock assembly 12 is representatively illustrated in the wellbore lining 26. In this view, it may seen that multiple receptacles 20 are provided in the deflector 30.

In this example, each receptacle 20 is configured to receive a separate blade 16 of the window mill 18. However, in other examples, multiple blades 16 could be received in a single receptacle 20. Thus, any number of receptacles 20 may be used, in keeping with the scope of this disclosure.

The centralizer 36 is not used in the FIG. 2 example. The profiles 20 are depicted as being located in the deflector 30, but in other examples the profiles could be otherwise located. Thus, it will be appreciated that the scope of this disclosure is not limited to use of any particular number, combination or arrangement of components in the whipstock assembly 12.

Figure 3:
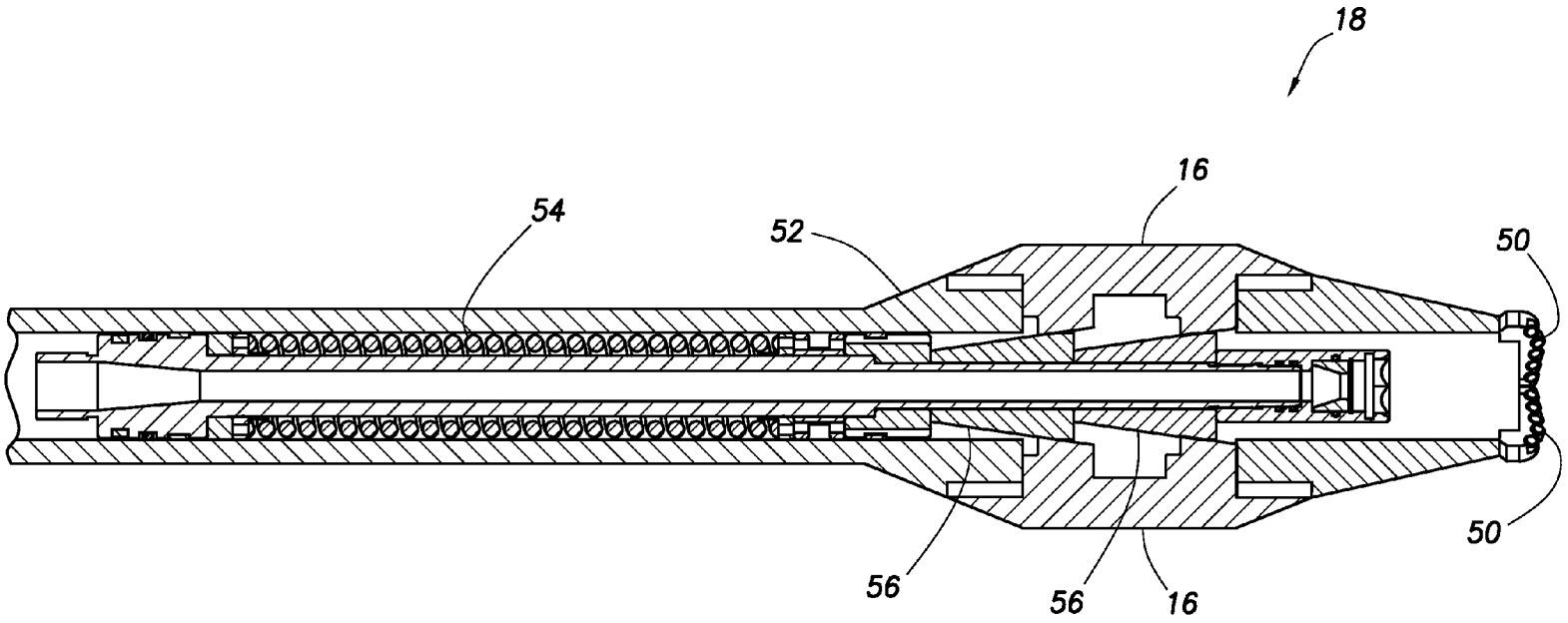
FIG. 3 is a representative cross-sectional view of a window mill which may be used in the system and method of FIG. 1, the window mill being depicted with blades thereof in an extended position.

Referring additionally now to FIG. 3, an enlarged scale cross-sectional view of the window mill 18 is representatively illustrated. In this view, it may be seen that the mill 18 includes cutters 50 (such as polycrystalline diamond compact (PDC) cutters, etc.) at a leading end thereof, and so the window mill is of the type known to those skilled in the art as a "lead" mill.

The mill 18 in this example is used to initiate cutting of the window 44 through the wellbore lining 26. The cutters 50 cut an initial opening through the wellbore lining 26, and the blades 16 are used to enlarge the opening.

In other examples, the mill 18 could instead be of the type known to those skilled in the art as a watermelon or barrel mill. In that case, the mill 18 may not be used to initiate cutting through the wellbore lining 26. Thus, it will be appreciated that the scope of this disclosure is not limited to use with any particular type of window mill.

In the FIG. 3 configuration, the blades 16 are radially outwardly extended relative to a body 52 of the mill 18. A biasing device 54 (such as, a spring, a compressed gas chamber, etc.) biases wedges 56 to the left as viewed in FIG. 3. The wedges 56 in this position outwardly support the blades 16 for cutting the window 44.

The blades 16 preferably have an external profile which is complementarily shaped relative to an internal profile of the receptacles 20. Thus, the blades 16 can be readily received in the receptacles 20, and this engagement between the blades and the receptacles can be used to convey the whipstock assembly 12 into and/or out of the wellbore 22 by the tubular string 14.

In the step of the method described above, wherein the mill 18 is deflected laterally by the deflector surface 46 to cut the window 44 through the wellbore lining 26, another mill (such as a watermelon or barrel mill) with extendable blades could be used to ensure that the mill 18 tracks properly along the deflector surface. For example, the additional mill could be connected above the lead mill, and blades of both mills could be extended outwardly after the tubular string 14 is withdrawn above the deflector surface 46, so that when the tubular string is again displaced downwardly, both of the mills will contact the deflector surface, and greater stability will result.

Figure 4:
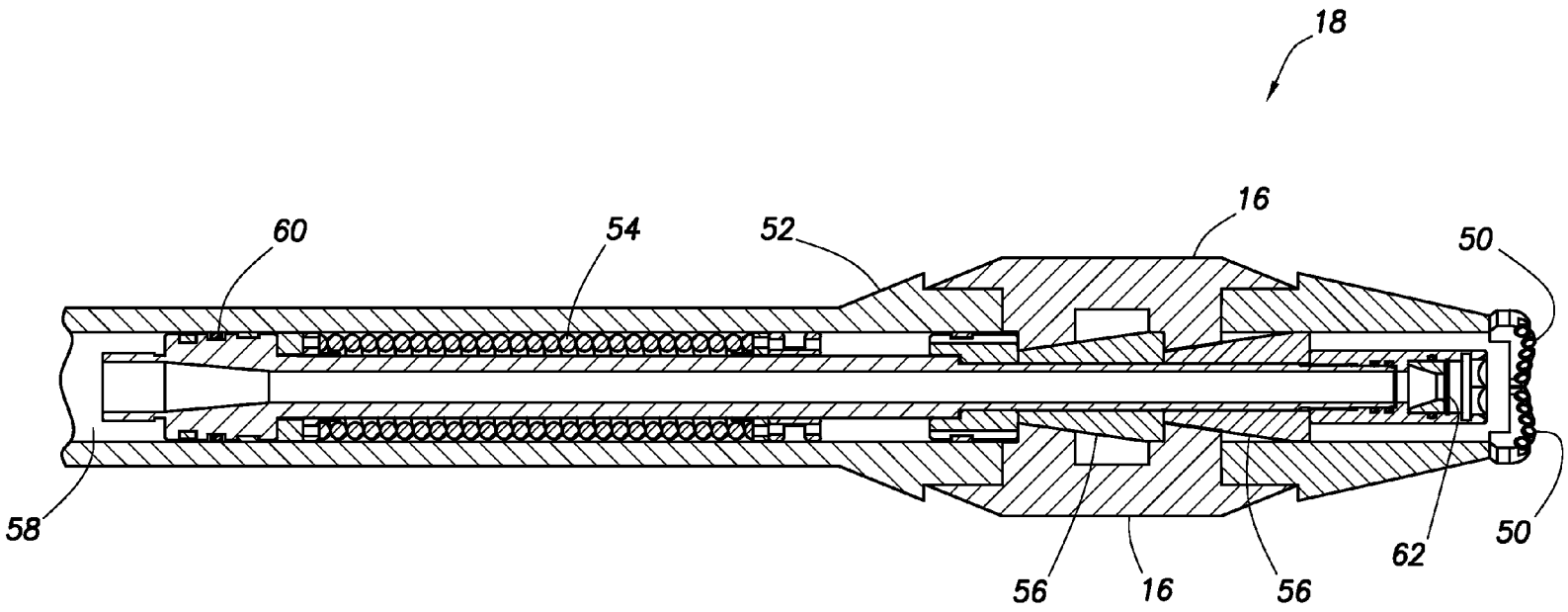
FIG. 4 is a representative cross-sectional view of the window mill with the blades in a retracted position.

Referring additionally now to FIG. 4, the window mill 18 is representatively illustrated with the blades 16 in their radially inwardly retracted configuration. This configuration is achieved by applying increased pressure to an interior flow passage 58 of the tubular string 14 and mill 18.

The increased pressure differential from an interior to an exterior of the mill 18 causes a piston 60 to displace to the right as viewed in FIG. 4, thereby compressing the biasing device 54. The wedges 56 are, thus, displaced to the right, and the blades 16 are no longer outwardly supported by the wedges.

The pressure differential from the interior to the exterior of the mill 18 can be decreased (e.g., by decreasing pressure applied to the passage 58) at any time it is desired to again outwardly extend the blades 16. If circulation through the tubular string 14 via the passage 58 is desired, pressure in the passage can be increased sufficiently to burst a rupture disk 62.

If the rupture disk 62 is burst, then the blades 16 can still be retracted when desired by flowing fluid through the passage 58 at a sufficient flow rate to cause a pressure differential to be created from the interior to the exterior of the mill 18, so that the piston 60 will displace to the right, as depicted in FIG. 4.

Figure 5:
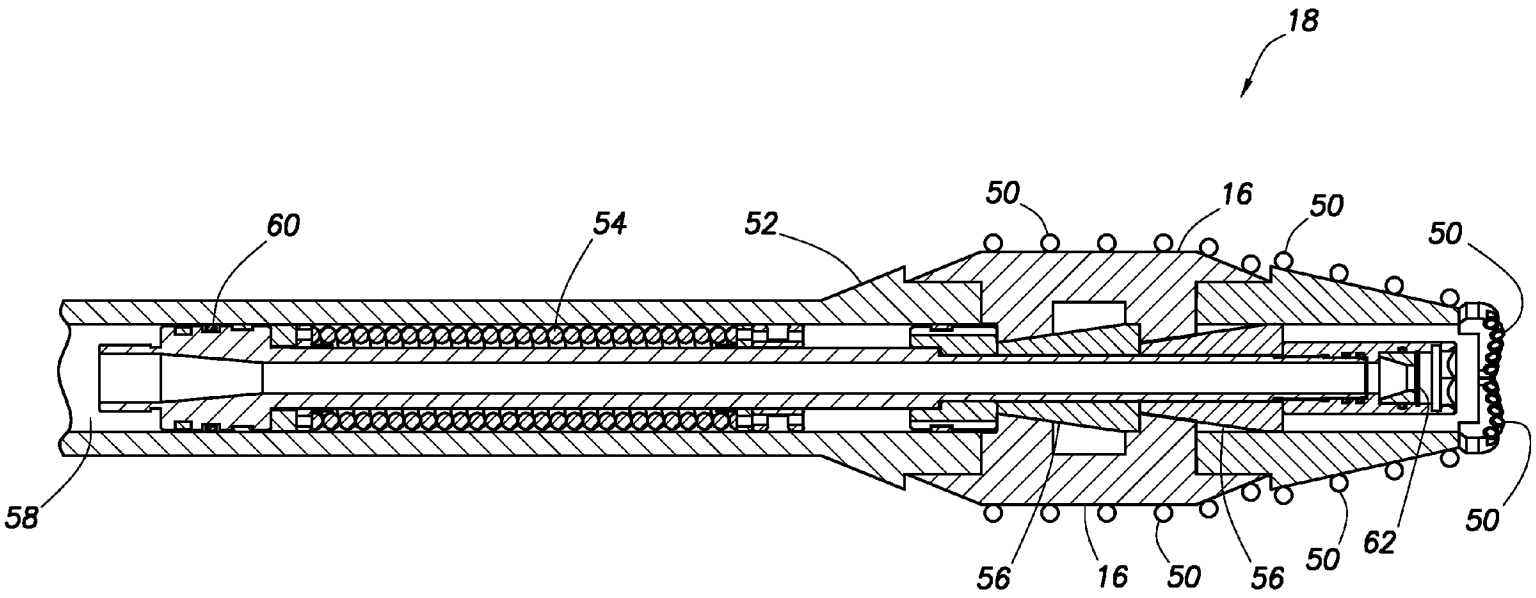
FIG. 5 is a representative cross-sectional view of another example of the window mill.

Referring additionally now to FIG. 5, another example of the window mill 18 is representatively illustrated. In this example, the cutters 50 are used on additional portions of the window mill 18, including on the retractable blades 16, as well as on stationary or non-retractable portions of the window mill.

The FIG. 5 window mill 18 is suitable for both cutting the window 44 through the lining 26, and for drilling the branch wellbore 24 outward from the window. Thus, there is no need, after the window 44 has been milled through the lining 26, to retrieve the tubular string 14 and replace the mill 18 with a drill bit suitable for penetrating an earth formation. In this manner, yet another trip into the wellbore 22 can be avoided.

Note that it is not necessary for the cutters 50 to be positioned on the retractable blades 16, or for the retractable blades to be used at all. In some examples, a conventional PDC drill bit may be used for the mill 18, in which case the PDC drill bit can be used for both cutting the window 44 through the lining 26, and for drilling the wellbore 24.

In some examples, it would be desirable, however, to prevent contact between the cutters 50 and the surface 46 of the deflector 30, in order to prevent damage to the deflector surface. This damage prevention may be desirable whether or not the cutters 50 are positioned on the retractable blades 16, or are on a conventional PDC drill bit, etc.

Figure 6:
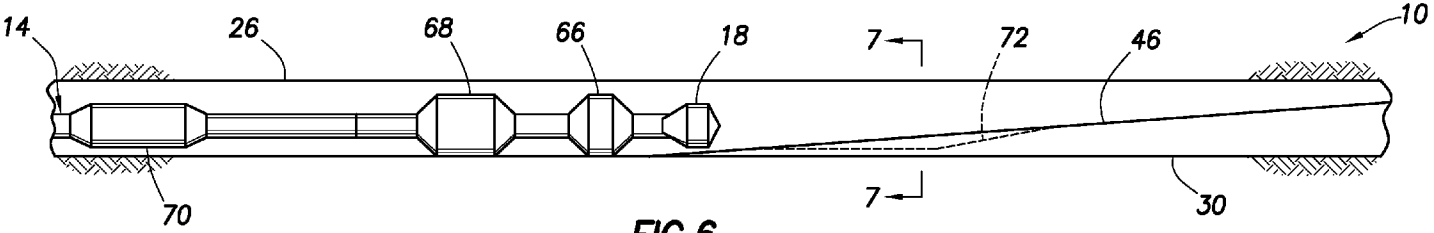
FIG. 6 is a representative cross-sectional view of another example of the window milling system.
Figure 7:
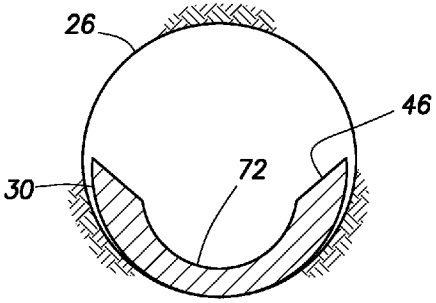
FIG. 7 is an enlarged scale representative cross-sectional view of a deflector, taken along line 7-7 of FIG. 6.
Figure 8:
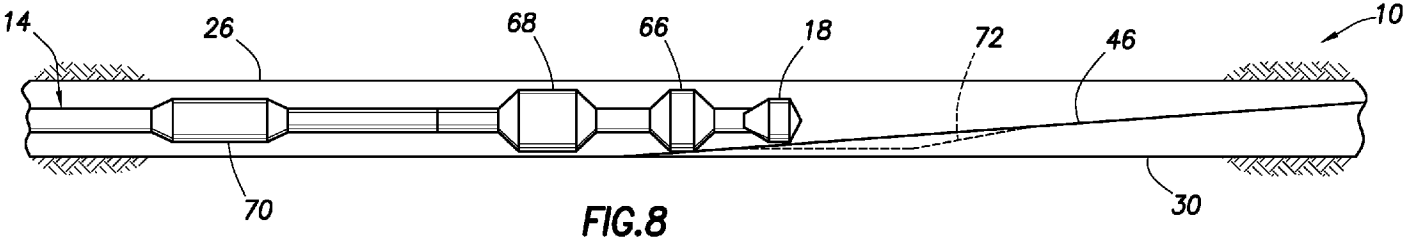
FIG. 8 is a representative cross-sectional view of the FIG. 6 window milling system, with the window mill traversing a deflector surface of the deflector.

Representatively illustrated in FIGS. 6-8 is another example of the window milling system 10, in which the window mill 18 is used both to mill the window 44 through the lining 26, and to drill the wellbore 24. In this example, the mill 18 is prevented from contacting the deflector surface 46. A conventional drill bit (e.g., a PDC or other type of drill bit) may be used for the mill 18 in other examples.

In FIG. 6, it may be seen that a guide mill 66, a watermelon mill 68 and a reamer 70 are connected in the tubular string 14 above (to the left in FIG. 6) the mill 18. The guide mill 66 and watermelon mill 68 have somewhat larger outer diameters than the mill 18, so that when the guide and/or watermelon mills are in contact with the deflector surface 46, the mill 18 is spaced away from the deflector surface.

As depicted in FIG. 6, the tubular string 14 (including the mills 18, 66, 68 and reamer 70) is displaced to the right toward the deflector 30. A longitudinally extending recess 72 is formed in the deflector 30. The recess 72 has a radius greater than that of the mill 18, so that the mill 18 does not contact the deflector surface 46 as the mill approaches the deflector 30.

An enlarged scale cross-sectional view of the deflector 30 is representatively illustrated in FIG. 7. In this view, it may be seen that the recess 72 has a smaller radius as compared to that of the surface 46.

Preferably, the recess 72 radius is between that of the mill 18 with the blades 16 retracted, and that of the other mills 66, 68. In this manner, the mill 18 will not contact the surface 46, but the other mills 66, 68 will contact the surface 46.

In FIG. 8, the tubular string 14 has been displaced further to the right, so that the guide mill 66 now contacts the deflector surface 46. Note that the mill 18 is thereby lifted somewhat out of the recess 72, due to lateral deflection caused by contact between the guide mill 66 and the surface 46, and is still prevented from contacting the deflector surface 46.

The guide mill 66 supports the mill 18 as it begins to cut through the lining 26 to form the window 44. When both of the mills 66, 68 are in contact with the surface 46, enhanced stability is provided for the mill 18, and the mill 18 is fully lifted out of the recess 72, and is still prevented from contacting the deflector surface 46.

The mill 18 cuts through the lining 26. The guide and watermelon mills 66, 68 radially enlarge the window 44. The reamer 70 finishes the window 44 milling process, so that the window has its final dimension.

The guide and/or watermelon mills 66, 68 may have retractable blades 16. The retractable blades 16 on the guide and/or watermelon mills 66, 68 may, when extended, serve to lift or maintain the mill 18 out of contact with the deflector surface 46. Retractable blades 16 may be used on the guide and/or watermelon mills 66, 68 in conjunction with, or instead of, the recess 72 in the deflector surface 46.

After milling the window 44, the tubular string 14 is displaced further downward (e.g., to the right as viewed in FIG. 7), so that the mills 18, 66, 68 and reamer 70 are then used for drilling the wellbore 24. The blades 16 may be in their retracted or extended positions during the drilling operation.

There is no need, in this example, for the mills 18, 66, 68 (or any of them) to be retrieved and replaced with a drill bit for drilling the wellbore. 24. Thus, a trip of the tubular string 14 out of, and back into, the wellbore 22 is not needed. This saves time and expense in the milling and drilling operations.

After the wellbore 24 has been drilled, the mill 18 can be used to retrieve the whipstock assembly 12 as described above, if the mill is provided with the retractable blades 16. Thus, there is no need, in this example, for the tubular string 14 to be tripped out and back into the well, in order to retrieve the whipstock assembly 12 after the wellbore 24 is drilled.

It may now be fully appreciated that the above disclosure provides significant advantages to the arts of constructing and operating window mills and whipstock assemblies in wells. In an example described above, the window mill 18 includes retractable blades 16 which allow the window mill to be used to convey the whipstock assembly 12 into and out of a well, so that the window 44 milling operation can be completed in only a single trip of the tubular string 14 and whipstock assembly into the wellbore 22. In another example, the mill 18 includes cutters 50 suitable for drilling the wellbore 24 after milling the window 44, so that the window milling and wellbore drilling operations can be completed in only the single trip of the tubular string 14 and whipstock assembly 12 into and out of the well.

A window milling system 10 for use in a subterranean well is provided to the art by the above disclosure. In one example, the system 10 can include a window mill 18 having selectively retractable and extendable blades 16, and a whipstock assembly 12 having at least one receptacle 20 therein. The window mill 18 is secured relative to the whipstock assembly 12 by receipt of the blades 16 in the receptacle 20.

The window mill 18 can be released from the whipstock assembly 12 by displacement of the blades 16 to their retracted positions.

The window mill 18 can be secured to the whipstock assembly 12 by displacement of the blades 16 to their extended positions.

The blades 16 may be displaced between their extended and retracted positions in response to pressure differential variations across the window mill 18 (e.g., different pressure differentials between an interior and an exterior of the window mill).

The whipstock assembly 12 may be conveyed from and/or into the well by the window mill 18.

The whipstock assembly 12 can include a deflector 30 which laterally deflects the window mill 18 with the blades 16 in their extended positions.

A method of cutting a window 44 through a wellbore lining 26 in a subterranean well is also described above. In one example, the method can comprise: cutting through the wellbore lining 26 with a window mill 18; then retracting blades 16 of the window mill 18; and then outwardly extending the blades 16 in a whipstock assembly 12, thereby securing the whipstock assembly 12 to the window mill 18.

The method can also include conveying the whipstock assembly 12 out of and/or into the well on the window mill 18.

The method can include retracting the blades 16 prior to the cutting step. The retracting step can include releasing the window mill 18 from at least one receptacle 20 of the whipstock assembly 12.

The outwardly extending step can include receiving the blades 16 in at least one receptacle 20 of the whipstock assembly 12.

The retracting step can include increasing pressure in the window mill 18. The outwardly extending step can include decreasing pressure in the window mill 18.

A window mill 18 is also described above. In one example, the window mill 18 can include multiple blades 16 adapted for cutting through a wellbore lining 26, the blades 16 being outwardly extendable relative to a body 52 of the window mill 18 in the well.

The blades 16 may extend outwardly in response to decreased pressure in the window mill 18. The blades 16 may be inwardly retracted in response to increased pressure in the window mill 18.

Each of the blades 16 may have an external profile complementarily shaped relative to a receptacle 20 profile of a whipstock assembly 12.

Fluid flow through the window mill 18 may be permitted in response to application of a predetermined pressure differential from an interior to an exterior of the window mill 18.

Another method of cutting a window 44 through a wellbore lining 26 in a subterranean well is described above. In one example, the method can comprise cutting through the wellbore lining 26 with a window mill 18; and the window mill 18 drilling a wellbore 24 outward a substantial distance from the window 44 after the cutting.

The substantial distance is greater than that needed to form the window 44. Preferably, the wellbore 24 is drilled to its terminal depth or length, or at least a substantial portion of its length, using the window mill 18.

The method can include retracting blades 16 of the window mill 18 after the drilling step.

The method can also include outwardly extending the blades 16 in a whipstock assembly 12, thereby securing the whipstock assembly 12 to the window mill 18.

The method can include conveying the whipstock assembly 12 out of the well on the window mill 18.

The method can include conveying the whipstock assembly 12 into the well on the window mill 18.

The method can include retracting the blades 16 prior to the cutting step.

The step of retracting the blades 16 prior to the cutting step can include releasing the window mill 18 from at least one receptacle 20 of the whipstock assembly 12.

The whipstock assembly 12 may include a deflector 30 having an inclined surface 46 which laterally deflects another mill 66, 68 connected in a same tubular string 14 as the window mill 18. A recess 72 formed in the inclined surface 46 may prevent the window mill 18 from contacting the inclined surface 46.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A window milling system for use in a subterranean well, the system comprising:

a window mill comprising selectively retractable and extendable blades; and a whipstock assembly comprising at least one receptacle therein, the window mill being securable relative to the whipstock assembly by receipt of the blades in the receptacle.

2. The system of claim 1, wherein the window mill is released from the whipstock assembly by displacement of the blades to their retracted positions.

3. The system of claim 1, wherein the window mill is secured to the whipstock assembly further by displacement of the blades to their extended positions.

4. The system of claim 1, wherein the blades are displaced between their extended and retracted positions in response to pressure differential variations across the window mill.

5. The system of claim 1, wherein the whipstock assembly is conveyable from the well by the window mill.

6. The system of claim 1, wherein the whipstock assembly is conveyable into the well by the window mill.

7. The system of claim 1, wherein the whipstock assembly includes a deflector configured to laterally deflect the window mill with the blades in their extended positions.

8. The system of claim 1, wherein the whipstock assembly includes a deflector comprising an inclined surface configured laterally to deflect another mill connected in a same tubular string as the window mill.

9. The system of claim 8, wherein a recess formed in the inclined surface is configured to prevent the window mill from contacting the inclined surface.

10. The system of claim 1, wherein the window mill is configured to drill a wellbore outward a substantial distance from a window milled through a wellbore lining by the window mill.

11. A method of cutting a window through a wellbore lining in a subterranean well, the method comprising:

cutting through the wellbore lining with a window mill;

retracting blades of the window mill; and outwardly extending the blades in a whipstock assembly, thereby securing the whipstock assembly to the window mill.

12. The method of claim 11, further comprising conveying the whipstock assembly out of the well on the window mill.

13. The method of claim 11, further comprising conveying the whipstock assembly into the well on the window mill.

14. The method of claim 11, further comprising retracting the blades prior to the cutting.

15. The method of claim 14, wherein the retracting the blade prior to the cutting further comprises releasing the window mill from at least one receptacle of the whipstock assembly.

16. The method of claim 11, wherein the outwardly extending further comprises receiving the blades in at least one receptacle of the whipstock assembly.

17. The method of claim 11, wherein the retracting the blades further comprises increasing pressure in the window mill.

18. The method of claim 11, wherein the outwardly extending further comprises decreasing pressure in the window mill.

19. The method of claim 11, further comprising laterally deflecting another mill with an inclined surface of a deflector of the whipstock assembly, the another mill connected in a same tubular string as the window mill.

20. The method of claim 19, further comprising preventing the window mill from contacting the inclined surface using a recess formed in the inclined surface.

21. The method of claim 19, further comprising preventing contact between the window mill and the inclined surface by outwardly extending blades on the other mill.

22. The method of claim 11, further comprising the window mill drilling a wellbore outward a substantial distance from the window after the cutting.

23. A window mill for use in a subterranean well, the window mill comprising:

multiple blades configured to cut through a wellbore lining, the blades being outwardly extendable relative to a body of the window mill in the well; and wherein outwardly extendable blades of another mill prevent contact between the window mill and an inclined surface of a deflector.

24. The window mill of claim 23, wherein the blades extend outwardly in response to decreased pressure in the window mill.

25. The window mill of claim 23, wherein the blades are inwardly retracted in response to increased pressure in the window mill.

26. The window mill of claim 23, wherein each of the blades comprises an external profile complementarily shaped relative to a receptacle profile of a whipstock assembly.

27. The window mill of claim 23, wherein fluid flow through the window mill is permitted in response to application of a predetermined pressure differential from an interior to an exterior of the window mill.

28. The window mill of claim 23, further comprising cutters mounted on the retractable blades.

29. The window mill of claim 28, wherein the cutters comprise polycrystalline diamond compact cutters.

30. The window mill of claim 28, wherein the cutters are configured to drill through an earth formation.

31. A method of cutting a window through a wellbore lining in a subterranean well, the method comprising:

cutting through the wellbore lining with a window mill;

drilling a wellbore outward a substantial distance from the window with the window mill after the cutting; and preventing contact between the window mill and an included surface of a deflector by outwardly extending blades on another mill.

32. The method of claim 31, further comprising retracting blades of the window mill after the drilling.

33. The method of claim 32, further comprising outwardly extending the blades in a whipstock assembly, thereby securing the whipstock assembly to the window mill.

34. The method of claim 33, further comprising conveying the whipstock assembly out of the well on the window mill.

35. The method of claim 34, further comprising conveying the whipstock assembly into the well on the window mill.

36. The method of claim 32, further comprising retracting the blades prior to the cutting.

37. The method of claim 36, wherein the retracting the blades prior to the cutting further comprises releasing the window mill from at least one receptacle of the whipstock assembly.

38. The method of claim 31, further comprising laterally deflecting the another mill using a whipstock assembly comprising the deflector with an inclined surface, the another mill connected in a same tubular string as the window mill.

39. The method of claim 38, further comprising preventing the window mill from contacting the inclined surface using a recess formed in the inclined surface.

* * * * *